US005364659A

United States Patent [19]

Rapp et al.

[11] Patent Number: 5,364,659

[45] Date of Patent: Nov. 15, 1994

[54] CODEPOSITION OF CHROMIUM AND SILICON DIFFUSION COATINGS IN FE-BASE ALLOYS USING PACK CEMENTATION

[75] Inventors: Robert A. Rapp; Mark A. Harper, both of Columbus, Ohio

[73] Assignee: Ohio State University Research Foundation, Columbus, Ohio

[21] Appl. No.: 116,302

[22] Filed: Sep. 3, 1993

Related U.S. Application Data

[63] Continuation of Ser. No. 839,979, Feb. 21, 1992, abandoned.

[51] Int. Cl.[5] ..... C23C 16/00

[52] U.S. Cl. ..... 427/253; 427/255.1

[58] Field of Search ..... 427/253, 255.1

[56] References Cited

U.S. PATENT DOCUMENTS

| | | | |
|---|---|---|---|
| 3,061,463 | 10/1962 | Samuel | 427/253 |
| 4,041,196 | 8/1977 | Baldi et al. | 427/252 |
| 4,096,296 | 6/1978 | Galmiche et al. | 427/247 |
| 4,156,042 | 5/1979 | Hayman et al. | 427/253 |
| 4,208,453 | 6/1980 | Baldi | 427/237 |
| 4,290,391 | 9/1981 | Baldi | 122/511 |
| 4,471,008 | 9/1984 | Huther | 427/383.5 |
| 4,687,684 | 8/1987 | Restall et al. | 427/248.1 |
| 4,812,179 | 3/1989 | Sayles | 149/19.2 |
| 4,904,501 | 2/1990 | Davis | 427/253 |
| 5,041,309 | 8/1991 | Davis et al. | 427/217 |

FOREIGN PATENT DOCUMENTS

| | | | |
|---|---|---|---|
| 806618 | 2/1969 | Canada . | |
| 1571698 | 6/1969 | France . | |
| 915089 | 1/1963 | United Kingdom | 427/253 |

OTHER PUBLICATIONS

Harper, Mark A., "Simultaneous Chromizing-Siliconizing of 409 Stainless Steel and Interstitial-Free Steel", ASM International Undergraduate Paper Contest, Jun., 1989.

Rapp, Robert A., "Pack Cementation Coating of Steel for High-Temperature Applications", Corrosion 88, St. Louis, Mo., Mar. 21-25, 1988.

Choquet, P. A., Harper, M. A., and Rapp, R. A., "Chromizing-Aluminizing and Chromizing-Siliconizing Coating of a Ferritic Steel", The Proceedings of the 7th European Conference, Perpignan, France, Jun. 19-23, 1989.

Harper, Mark A. and Rapp, Robert A., "Chromized/-Siliconized Diffusion Coatings for Iron-Base Alloys by Pack Cementation", Corrosion 91, Cincinnati, Ohio, Mar. 11-15, 1991.

Harper, Mark A. and Rapp, Robert A., "Chromized/-Siliconized Pack Cementation Diffusion Coatings for Heat Resistant Alloys," ASM Conference, Fontana, Wis., Sep. 23-26, 1991.

Harper, M. A. and Rapp R. A., "Codeposition of Chromium and Silicon in Diffusion Coatings for Iron-Base Alloys Using Pack Cementation", Surface Modification Technologies IV, Mar. 29, 1991.

Bianco, Robert, Harper, M. A., and Rapp, R. A., "Codeposition of Elements in Diffusion Coatings by the Halide Activated Pack Cementation Method," Journal of Metals, Nov. 1991.

Galmiche, Philippe, "Chromaluminisation et Tantalisation des Materiaux Refractaires pour Turbines a Gaz, Metals and Materials", 1968.

*Primary Examiner*—Paul E. Konopka

*Attorney, Agent, or Firm*—Daniel S. Kalka; Robert J. Edwards

[57] ABSTRACT

Diffusion coatings incorporating approximately 18 to 35 wt % Cr and 1 to 3% Si in 2.25Cr-1.0Mo steel and 1018 steel have been produced using a pack cementation method. The codeposition of these concentrations of Cr and Si into the 2.25Cr-1.0Mo and 1018 steel requires the use of a "mixed activator" (fused salt solution of NaF and NaCl). Cyclic oxidation tests in air at 700° C. of a coated 2.25Cr-1.0Mo steel coupon with a surface concentration of 34Cr-3Si have shown excellent cyclic oxidation resistance. Furthermore, a 1018 coupon coated to a surface concentration of Fe-30 wt % Cr-3Si shows negligible aqueous corrosion in an aerated 3.5% NaCl solution at room temperature. These coatings have provided similar protection in more complex oxidizing and reducing atmospheres.

10 Claims, 9 Drawing Sheets

Cr-Si BINARY PHASE DIAGRAM

Cr-Si BINARY PHASE DIAGRAM

CODEPOSITION OF CHROMIUM AND SILICON DIFFUSION COATINGS IN FE-BASE ALLOYS USING PACK CEMENTATION

This is a continuation of application Ser. No. 07/839,979 filed Febb. 21, 1992 now abandoned.

BACKGROUND OF THE INVENTION

1. Field of the Invention

The present invention relates in general to a method of coating a metal member and in particular to a new and useful method for the codeposition of chromium and silicon for coating iron-base (Fe-base) alloys using a pack cementation process.

2. Description of the Related Art

It is common in the field of coating metals or alloys to use a pack cementation process. Generally, a pack cementation process is a modified chemical vapor deposition process which consists of heating a closed or vented pack to an elevated temperature for a specific amount of time during which a diffusional coating is produced on a metal. The closed or vented cementation pack is protected from oxidation by an inert or reducing atmosphere. The cementation pack usually consists of the metal or alloy member or substrate that is to be coated surrounded by the elements to be deposited usually in the form of a powder masteralloy, a halide activator salt and a powder filler. An inert gas, such as argon, or else hydrogen is used to surround the pack. Once the pack is heated to a sufficiently elevated temperature, the activator salt reacts with the elements of the masteralloy to form metallic halide vapors. The metallic halide vapors diffuse to the substrate or metal surface through the gas phase in the porous pack. At the substrate surface, a reaction step results in the formation of a protective coating on the metal surface; the surface reaction may be somewhat complex, involving adsorption, dissociation, and/or surface diffusion of the molecular species.

The goal of coating a workpiece, this term meaning to include either a pure metal or a metal alloy object or substrate, is to provide a corrosion-and oxidation-resistant coating which will enhance the use and service life of the workpiece in severe environments.

Currently, most commercial cementation coating processes involve the deposition of single elements such as aluminum, chromium or silicon. There are, however, some processes that are advertised that involve deposition of two elements such as chromium and aluminum, or aluminum and silicon, that involve a complex two-step procedure that consists of incorporating these elements sequentially into the metal or substrate surface. However, the resulting elemental distributions are not optimal for oxidation/corrosion resistance.

A common problem encountered in the current commercial pack cementation coating processes results when chromium is introduced by the coating process to a workpiece that contains significant carbon content. A chromium carbide layer will form and subsequently block the inward diffusion of the protective chromium constituent into the workpiece. Therefore, those metals which do contain carbon and are subjected to a coating process involving chromium will have a resulting coating that is not optimally effective against the corrosive elements in many severe environments.

SUMMARY OF THE INVENTION

The present invention comprises the codeposition of chromium and silicon for the coating of a workpiece such as Fe-base metals or alloys in a one-step process using a pack cementation method.

This coating process comprises grinding smooth or cleaning all surfaces of the metal or alloy using grit paper or other technique. The metal or alloy substrate is then placed into a receptacle surrounded by the pack. The retort is then sealed, e.g. with a ceramic cement or by welding, and is positioned within a furnace having a uniform heating zone and is provided with an inert environment.

In the pack, both chromium and silicon are provided in the pack as a masteralloy having a proportion of chromium ranging from 65% to 99% by weight and silicon comprising 1% to 35% by weight.

A dual or mixed halide activator, which is necessary for the codeposition of Cr and Si in the desired amounts, is also provided to the pack. Such a dual halide activator may comprise sodium fluoride (NaF) and sodium chloride (NaCl). A satisfactory composition for the dual halide activator may be 75% to 99% sodium fluoride (NaF) and 1% by weight to 25% by weight sodium chloride (NaCl). The preliminary melting of the salt mixture is preferred.

A silica filler is also provided in the pack. A flow of an inert gas such as argon is provided to the retort in order to insure an inert surrounding atmosphere which prevents oxidation of the metal or alloy substrate and the chromium and silicon masteralloy.

A uniform heating zone is achieved having a temperature range between 800° C. and 1200° C. Such a temperature range may be maintained for a period of 8 to 30 hours.

The cementation pack comprising the workpiece, powdered masteralloy, activator salts, and the filler is treated as a closed system in thermodynamic equilibrium. The fused or volatile halide salts react with the elements in the source alloy to form metallic halide vapors which diffuse through the porous pack to the substrate. As the simplest condition, two metallic elements may be codeposited if their halide vapor species have comparable vapor pressures. If the halide vapor pressure of one component greatly exceeds that of the other, then the deposition of one element dominates (i.e., the conditions are either chromizing or else siliconizing).

In the reaction step for codeposition of chromium (Cr) and silicon (Si) into a Fe-based alloy, disproportionation reactions, displacement reactions, and reactions involving alkali vapor may occur as indicated:

A. Disproportionation Reactions:

$$3CrCl_2(v)=2CrCl_3(v)+Cr$$
$$3SiF_2(v)=2SiF_3(v)+Si$$
$$4SiF_3(v)=3SiF_4(v)+Si$$

B. Displacement Reactions:

$$CrCl_2(v)+Fe(s)=FeCl_2(v)+Cr$$

C. Alkali Reactions:

$$CrCl_2(v)+2Na(v)=Cr+2NaCl(1)$$
$$SiF_2(v)+2Na(v)=Si+2NaF(1)$$
$$5SiO_2(s)+4NaF(1)=2Na_2Si_2O_5(1)=SiF_4(v)$$

The upper limit for the composition(s) for a coating element(s) at the substrate surface is set by the limitation that the thermodynamic activity of the element(s) at the surface cannot be greater than its activity in the masteralloy. To calculate the equilibrium partial pressures of the halide species in the pack, the activities of the coating elements in the masteralloy must be known. Therefore, knowledge of the component activities in the masteralloy source in combination with proper choices of mixed activator salt and filler is essential to guide the processing to achieve the codeposition of two elements into the substrate. This joint selection of the specific masteralloy, the proper mixed activator salt, and the filler is not obvious to those skilled in the art.

In using the coating process described above, a metal or alloy substrate can be provided with a coating consisting of 20 to 40 weight percent chromium and 1 to 4 weight percent silicon. One such coating produced on 2.25 Cr-1Mo steel using a 90 Cr-10Si (wt. %) masteralloy and 95 NaF-5NaCl (mol %) activator salt heated at 1050° C. for 16 hr. was 225 microns (9 mils) thick with a surface composition of approximately Fe-38 wt % Cr-3Si.

An object of the present invention is to provide an economical process in order to coat metal or alloy substrates with a corrosion-resistant coating that can withstand high temperature environments such as air, combustion product gases, mixed $O_2$/S, $O_2$/C, and more complex multioxidant gases, and corrosion by fused salts.

Another object of the present invention is to provide a metal or alloy substrate coating that can resist certain corrosive aqueous environments.

A further object of the present invention is to provide a one-step process for the codeposition of two elements in a desired concentration which would reduce material, labor, energy costs, time and produce elemental distributions that would provide superior oxidation and corrosion resistance with adequate coating ductility.

Another object of the present invention is to provide a coating that does not have a carbide layer formed at the surface of the metal or alloy substrate.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

BRIEF DESCRIPTION OF THE DRAWINGS In the drawings.

Figure 8:
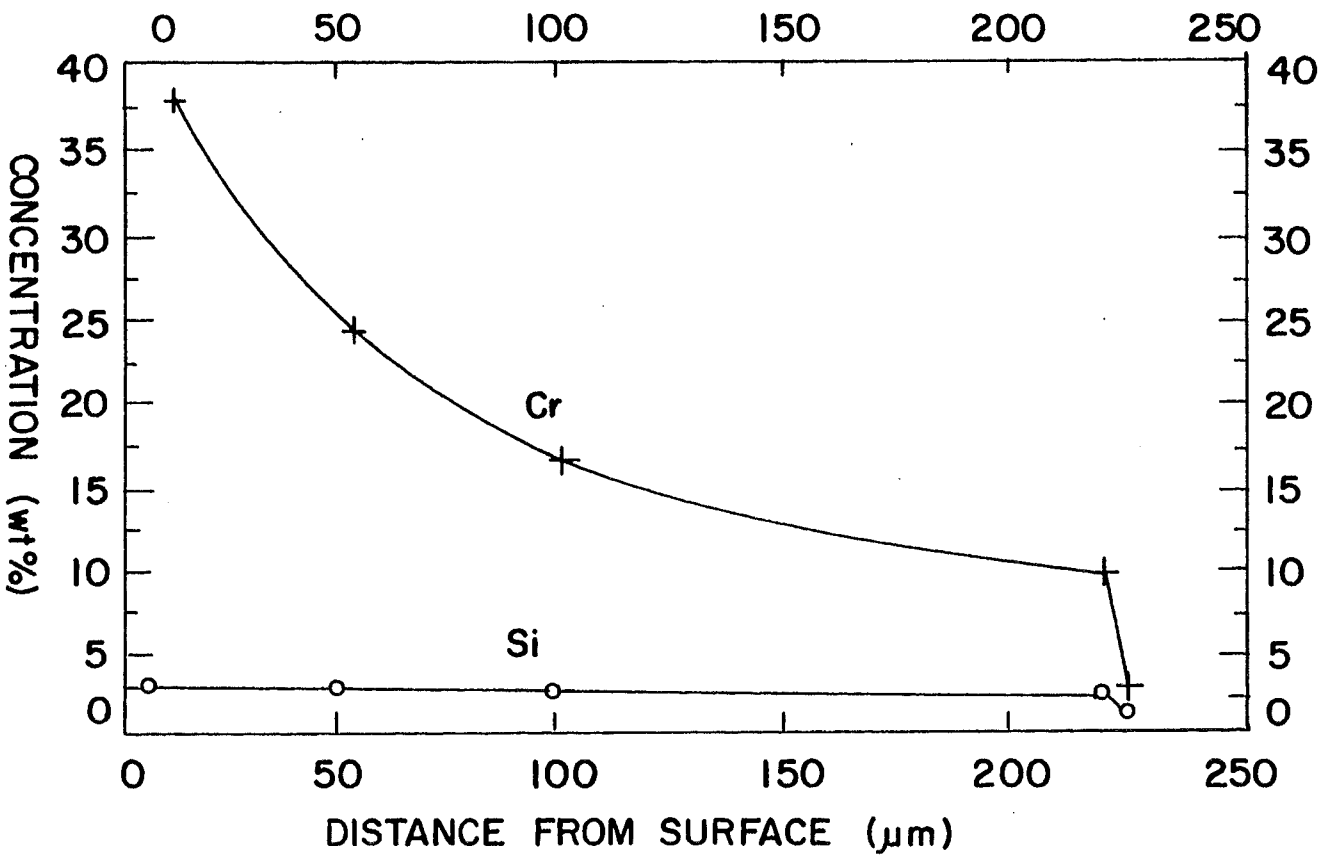
Figure 9:
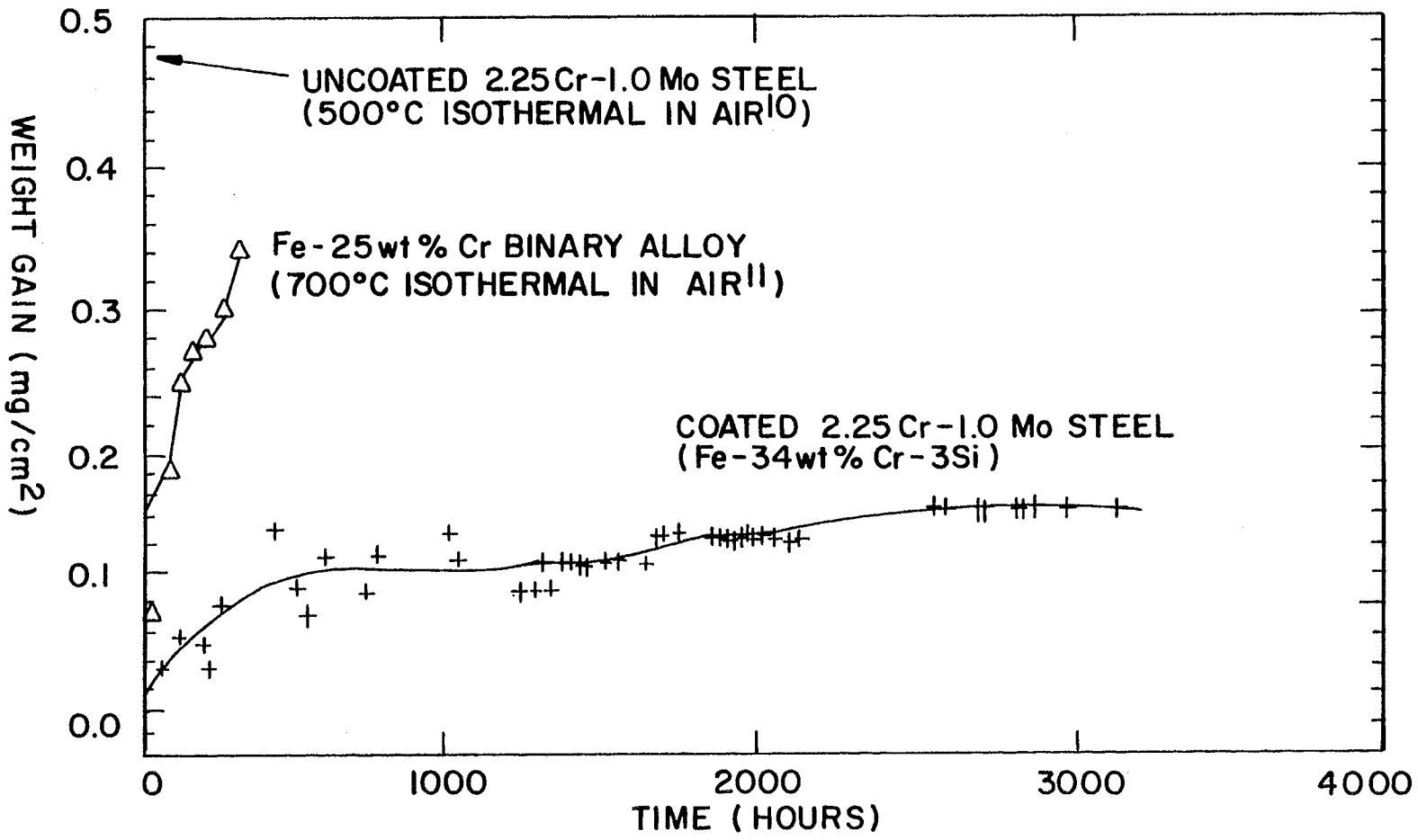

FIG. 8 is a graph plotting the concentration profiles for a coated Fe-2.25Cr-1.0Mo-0.15C steel using a 90Cr-10Si (wt %) masteralloy and 95 NaF-5NaCl (mol %) activator diffused at 1050° C. for 16 hours using an $SiO_2$ filler; and FIG. 9 is a graph plotting weight-gain versus time for the cyclic oxidation in air at 700° C. of a sample coated with a surface composition of 34Cr-3Si with each indicated point representing the weight-gain measured after cooling from 700° C. to room temperature.

DESCRIPTION OF THE PREFERRED EMBODIMENTS

Figure 1:
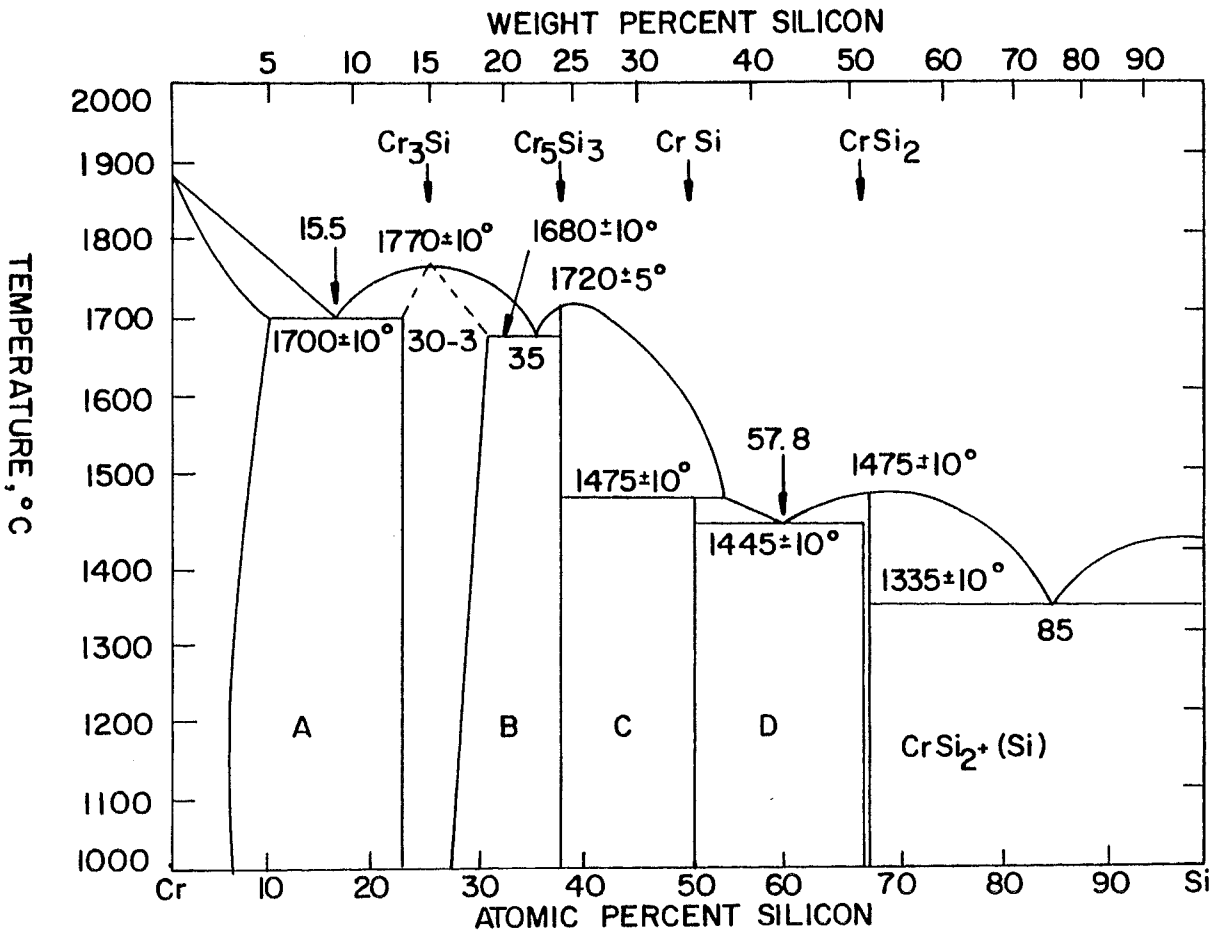
FIG. 1 is a graph showing the equilibrium phase diagram for the chromium-silicon binary system.

Referring to the drawings in particular, FIG. 1 shows the equilibrium phase diagram for the Cr—Si binary system. The two-phase regions are marked A, B, C and D.

Figure 2:
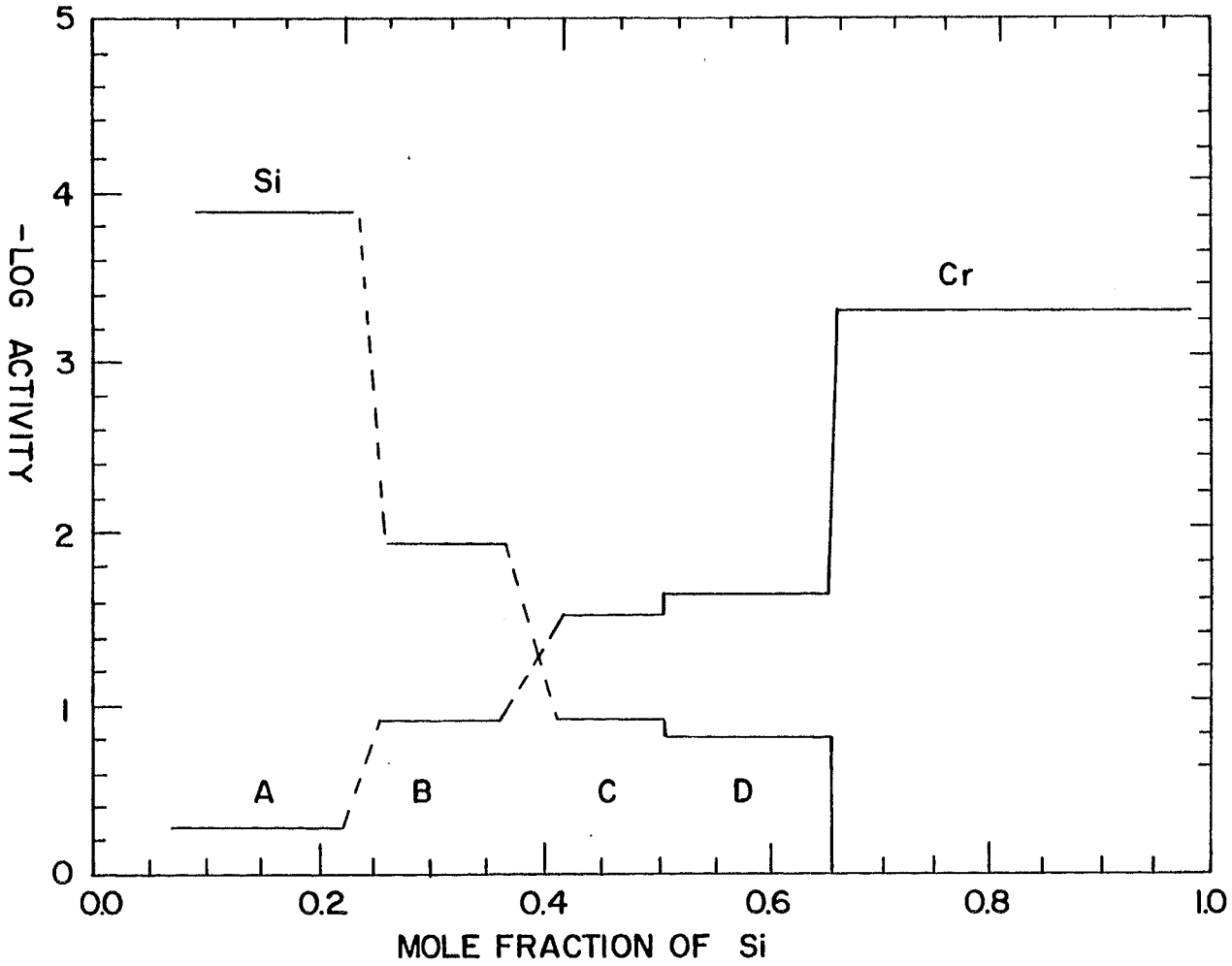
FIG. 2 is a graph for 1050° C. plotting -log thermodynamic activity versus mole fraction of silicon for chromium-silicon alloys.

Table 1 lists the activities of Cr and Si for the two-phase regions, and FIG. 2 shows a plot of -log (activity) versus the mole fraction of Si. The activities for Cr and Si are constant in the two-phase fields.

TABLE 1

Activities Calculated for Cr and Si for Two-Phase Regions of Cr—Si Binary System at 1050° C.

| Two Phase Region | $a_{Cr}$ | $a_{Si}$ |
|---|---|---|
| $CrSi_2$ + Si | $5.113 \times 10^{-4}$ | 1.0 |
| CrSi + $CrSi_2$ (D) | 0.0218 | 0.1531 |
| $Cr_5Si_3$ + CrSi (C) | 0.0292 | 0.1142 |
| $Cr_3Si$ + $Cr_5Si_3$ (B) | 0.1202 | 0.0112 |
| Cr + $Cr_3Si$ (A) | 0.5420 | $1.300 \times 10^{-4}$ |

For the present invention, the calculation of the equilibrium partial pressures was performed using the computer program ITSOL which is a modification of SOLGASMIX. The program calculates the equilibriuim partial pressures for a given temperature in a multicomponent system, and is based on the minimization of the Gibbs energy of the system and the conservation of mass for each element.

Four Cr—Si compositions: 90Cr-10Si, 80Cr-20Si, 70Cr-30Si, and 60 Cr-40Si (wt %), and four activators: NaCl, NaF, $FeCl_2$, and $CrCl_2$ were investigated by calculation. Calculations were performed for pack compositions consisting of:

1) 75.0 wt % filler ($SiO_2$)
2) 23.0 wt % masteralloy
3) 2.0 wt % halide activator salt.

In the equilibrium calculations, sodium is assumed to react with the $SiO_2$ filler to form the compound $Na_2Si_2O_5$.

Figure 3:
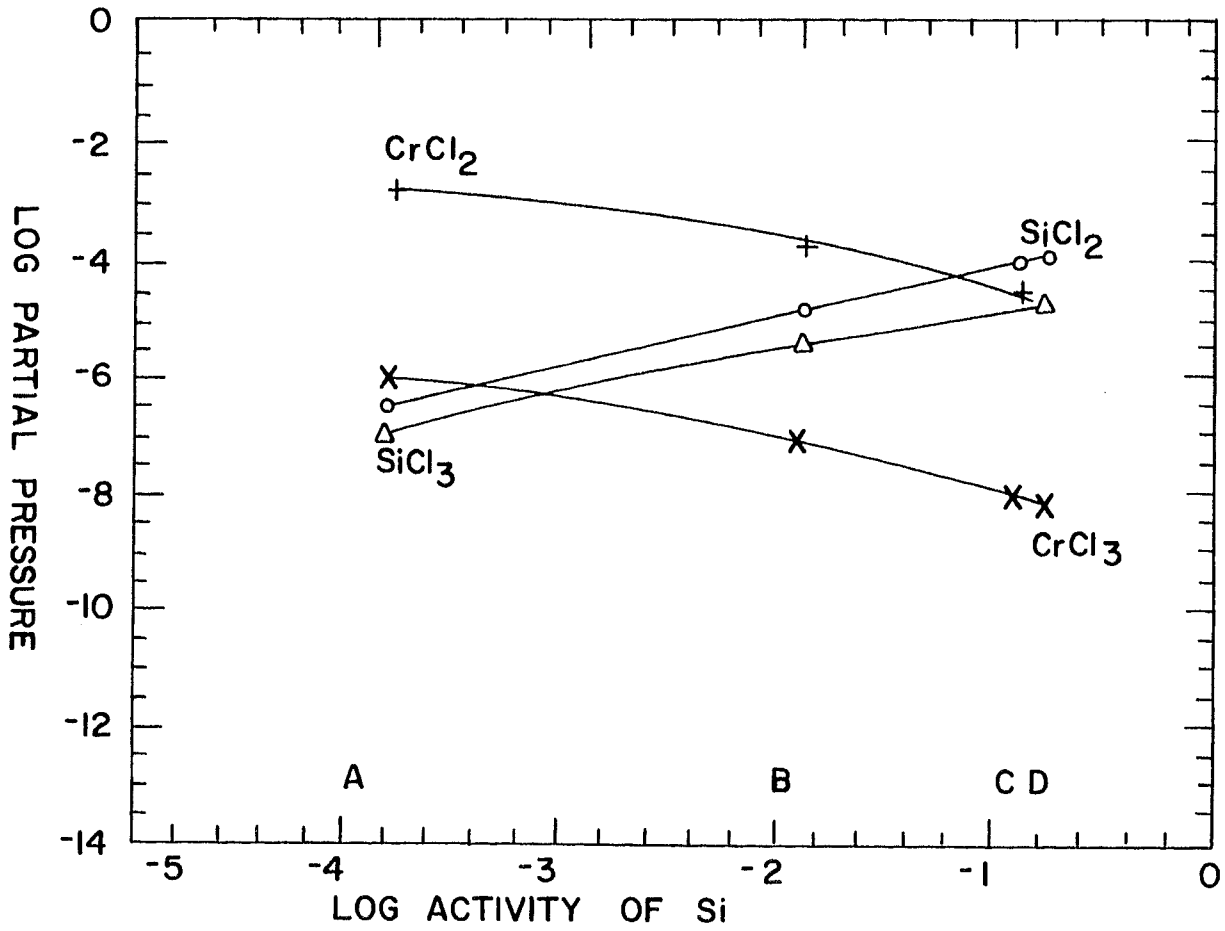
FIG. 3 is a graph plotting the equilibrium partial pressures of metallic halides in NaCl-activated packs containing Cr—Si masteralloys at 1050° C. with equilibrium achieved in the pack using an $SiO_2$ filler.
Figure 4:
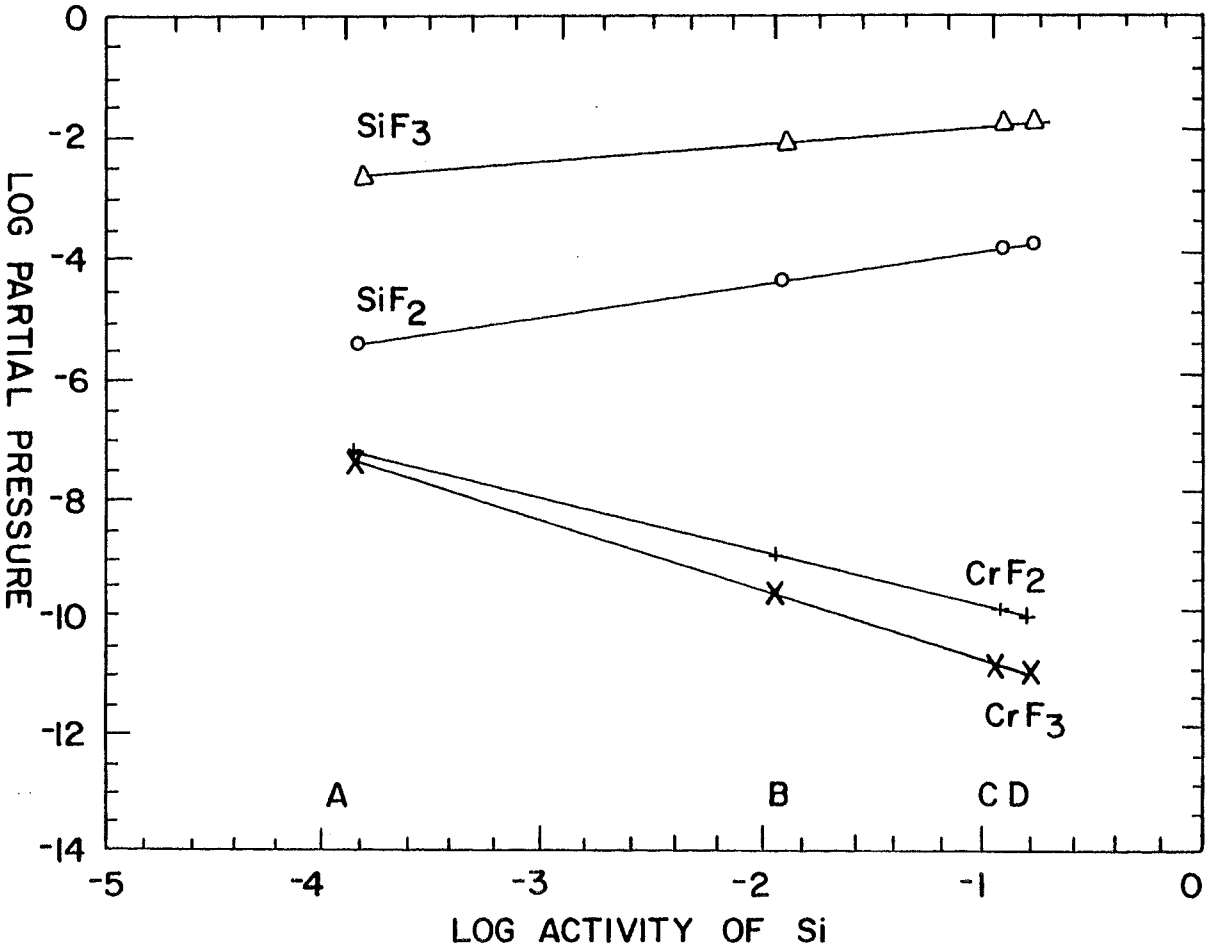
FIG. 4 is a graph plotting the equilibrium partial pressures of metallic halides in NaF-activated packs containing Cr—Si masteralloys at 1050° C. with equilibrium achieved in the pack using an $SiO_2$ filler.
Figure 5:
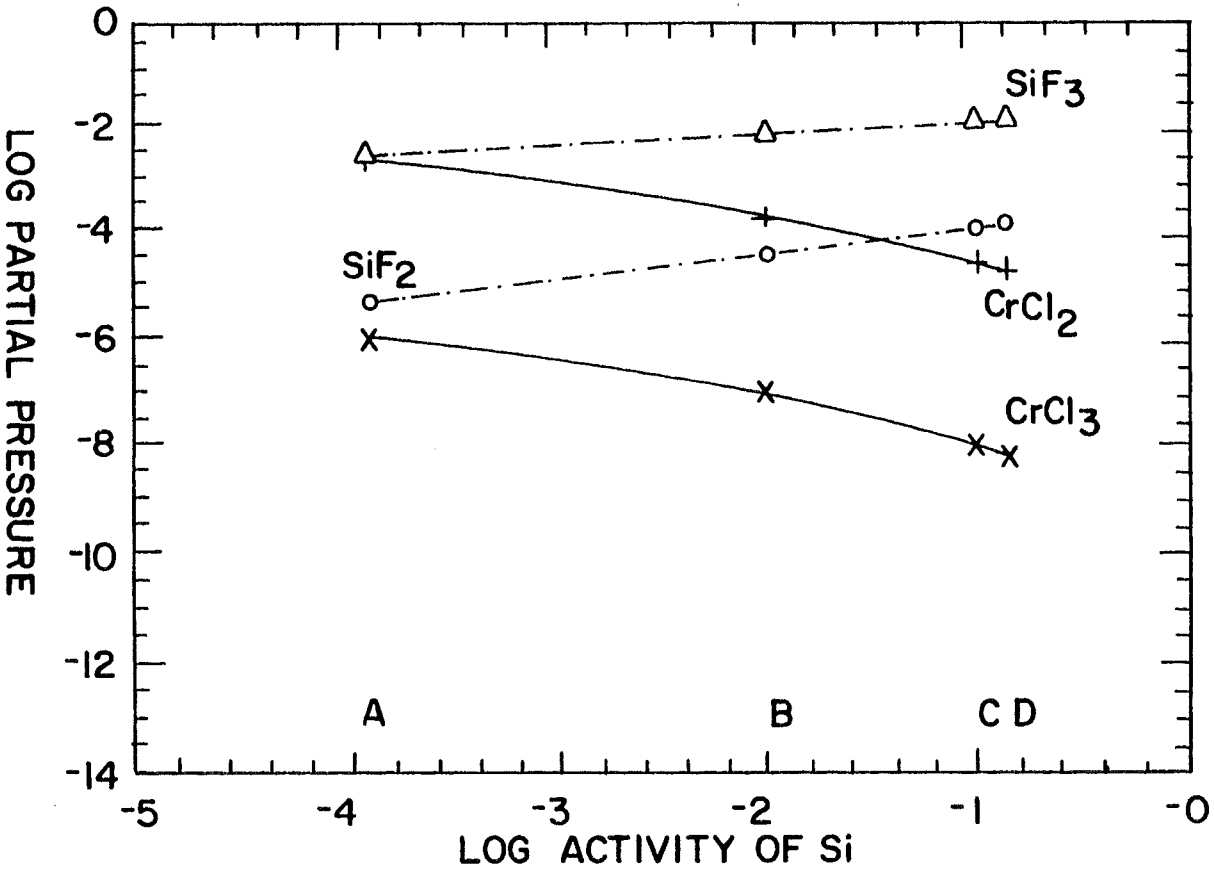
FIG. 5 is a superposition of highest pairs of lines from FIGS. 3 and 4, showing comparable partial pressures for halides of Cr and Si for masteralloy A.

FIGS. 3 and 4 show the variation in the calculated equilibrium partial pressures of the metallic halides as a function of the silicon activity in the packs. The four sets of data points marked on each figure correspond to the two-phase regions identified in FIG. 1.

FIG. 3 shows the equilibrium condition for a pack using a NaCl activator at 1050° C. Although FIG. 3 is correctly calculated for a continuous variation in Si activity, stable values can only be achieved for compositions in the two-phase fields indicated by the points A, B, C and D. From FIG. 3, the combination of masteralloy A with pure NaCl should result in dominant chromizing and inadequate siliconizing.

In FIG. 4, the vapor pressures are plotted for a pack containing only the NaF activator at 1050° C. From FIG. 4, for masteralloy A, the pure NaF activator should siliconize with inadequate chromizing.

The magnitude for $P_{SiF_2}$ from FIG. 4 over masteralloy composition A using the pure NaF activator is comparable to the magnitude for $P_{CrCl_2}$ from FIG. 3 over masteralloy composition A using the pure NaCl activator. The possibility for codeposition of Cr and Si then only exists for masteralloys corresponding to region A when a mixed NaCl/NaF activator of a proper composition, as well as the $SiO_2$ filler, is provided. In that case, the Cr is deposited via the $CrCl_2$ molecule, while the Si is deposited via the $SiF_2$ molecule. Thus, the mutual suitability of an activator, filler, and masteralloy composition in the Cr—Si system depends on the partial pressures of the Cr- and Si- halides being of comparable magnitude.

Figure 6:
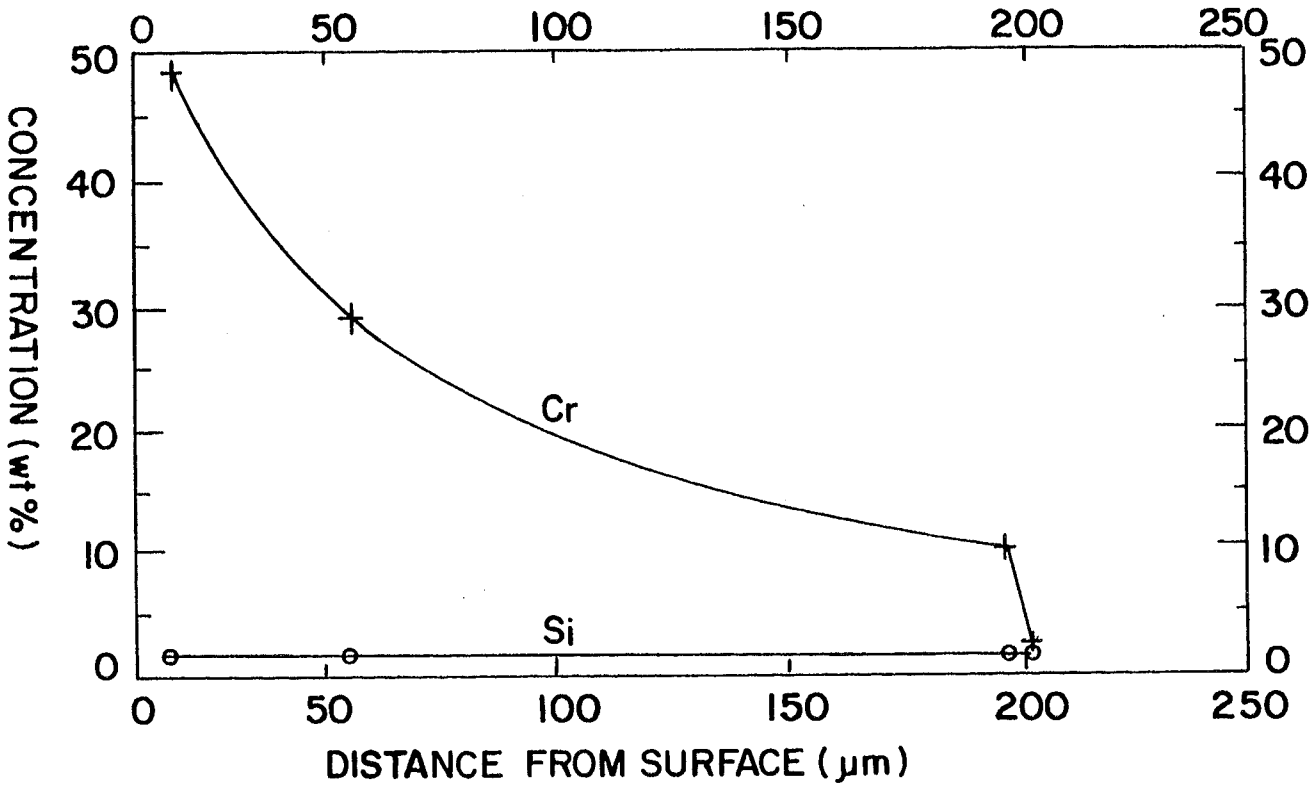
FIG. 6 is a graph plotting the concentration profiles for a coated Fe-2.25Cr-1.0Mo-0.15C steel using a 90Cr-10Si (wt %) masteralloy and a NaCl activator diffused at 1050° C. for 16 hours using an $SiO_2$ filler.
Figure 7:
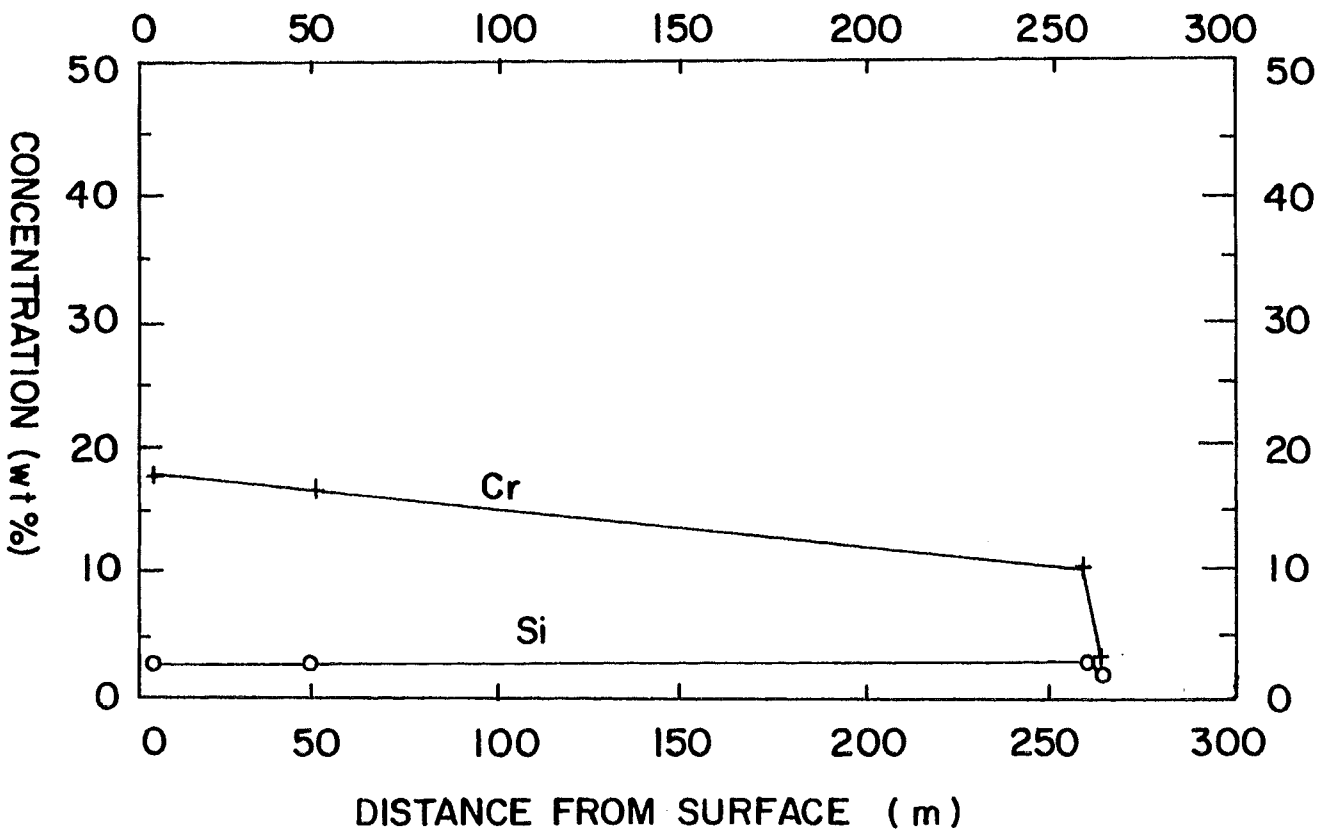
FIG. 7 is a graph plotting the concentration profiles for a coated Fe-2.25Cr-1.0-Mo-0.15C steel using a 90Cr-10Si (wt %) masteralloy and NaF activator diffused at 1070° C. for 20 hours using an $SiO_2$ filler.

FIG. 6 shows the compositional profile for an Fe-2.25Cr-1.0Mo-0.15C steel coated using a 90Cr-10Si masteralloy and a NaCl activator. As expected from the calculations, the substrate was essentially chromized with an insufficient amount of Si present. FIG. 7 shows the compositional profile for the same steel using a 90Cr-10Si masteralloy and a NaF activator. The codeposition of Cr and Si was achieved but the Cr content is less than desired, again as expected from the calculation. Thus, using this masteralloy the NaCl activator predominantly deposits Cr while the NaF activator deposits the desired amount of Si. For the given fixed activities of Cr and Si in the two-phase field A, codeposition was made possible by adjusting the relative concentrations (activities) of NaCl and NaF through the use of a mixed molten activator solution of an optimum concentration. FIG. 8 shows the composition profiles for an Fe-2.25Cr-1.0Mo-0.15C steel coated using a 90Cr-10Si masteralloy, an $SiO_2$ filler, and an activator consisting of 95NaF-5NaCl (mol %). This combination of masteralloy, filler, and activator produced a coating with a desirable surface composition of approximately 35Cr-3.5Si(wt %).

A coated coupon with a surface composition of 34Cr-3Si has been cyclically oxidized in air at 700° C. for four months (47 cycles to room temperature) with an almost negligible weight-gain and no detectable scale spalling. As shown in FIG. 9, the weight-gain is very low as the result of slow growth of an $SiO_2$ layer underneath an outer thin chromium oxide scale. This result shows an exceptional improvement in oxidation resistance compared to state of the art coatings. Also, coated coupons of 2.25Cr-1.0Mo steel with surface concentrations of approximately Fe-30 wt % Cr-3Si were sent to three industrial companies for testing in hot corrosion ($K_2SO_4$ and $Na_2SO_4$ fused salt attack) and corrosive gaseous (medium BTU fuel, i.e. reducing S-containing gas) atmospheres. In these tests, the coated steel substrates performed superior to or as good as alloys or coatings traditionally used in these environments. Furthermore, a coated AISI 1018 steel substrate with a surface concentration of Fe-30 wt % Cr-3Si showed negligible room temperature aqueous corrosion in an aerated 3.5% NaCl solution which simulates sea water corrosion.

Thus coatings with concentration profiles as shown in FIG. 8 exhibit excellent oxidation resistance. Such excellent moderate temperature scaling resistance is likely to be achieved also for complex oxidizing atmospheres, e.g. those involved with hot corrosion, coal gasification, refuse incineration, combustion product gases, petrochemical gases, etc. The improved aqueous corrosion resistance should prove beneficial during the shutdown or downtime of electric power plants, petrochemical plants, etc., where aqueous corrosion can play a significant damaging role.

While specific embodiments of the invention have been shown and described in detail to illustrate the application of the principles of the invention, it will be understood that the invention may be embodied otherwise without departing from such principles.

What is claimed is:

1. A pack cementation method of codepositing chromium and silicon coatings on an iron-base workpiece containing more than 0.08 percent carbon, comprising the steps of:

placing a surface of the workpiece into an inert atmosphere;

surrounding the surface of the workpiece with a chromium-silicon masteralloy in the inert atmosphere, the chromium-silicon masteralloy containing chromium ranging from about 65% to 99% by weight and silicon ranging from about 1% to 35% by weight;

providing a dual halide activator to the chromium-silicon masteralloy in the inert atmosphere, the dual halide activator being by weight from about 75% to 99% sodium fluoride and from about 1% to 25% sodium chloride;

providing a silica filler in the pack;

heating the workpiece surface, chromium-silicon masteralloy, dual halide activator and silica filler in the inert atmosphere to a temperature range between about 800° C. to 1200° C. which is sufficient to vaporize at least some of the coating elements;

reacting sodium from the dual halide activator with the silica filler; and maintaining the heating temperature range for a period of time sufficient to deposit a coating of chromium and silicon on the surface of the workpiece in one step.

2. A method according to claim 1, wherein the workpiece is an Fe-base alloy.

3. A method according to claim 1, wherein the inert atmosphere is argon.

4. A method according to claim 1, wherein the chromium comprises about 90% by weight of the chromium-silicon masteralloy and silicon comprises about 10% by weight.

5. A method according to claim 4, wherein the selected temperature is about 1050° C. for about 16 hours.

6. A method according to claim 5, wherein the dual halide activator includes about 95% sodium fluoride and about 5% sodium chloride.

7. A method according to claim 6, wherein the iron-base alloy is Fe-2.25Cr-1.0Mo-0.15C steel.

8. A method according to claim 1, wherein the period of time is about 8 to 30 hours.

9. A method according to claim 1, further comprising the step of melting the dual halide activator prior to providing it to the chromium-silicon masteralloy.

10. A method according to claim 1, wherein the pack comprises about 75% silica filler, about 23% chromium-silicon masteralloy and about 2.0% dual halide activator, on a weight percent basis.

* * * * *